US008109025B2

(12) United States Patent
Stone

(10) Patent No.: US 8,109,025 B2
(45) Date of Patent: Feb. 7, 2012

(54) TRIGGER ENGAGEMENT LINK FOR FIREARM

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 168 days.

(21) Appl. No.: 12/727,031

(22) Filed: Mar. 18, 2010

(65) Prior Publication Data

US 2010/0236120 A1 Sep. 23, 2010

Related U.S. Application Data

(60) Provisional application No. 61/162,197, filed on Mar. 20, 2009.

(51) Int. Cl.
*F41A 19/42* (2006.01)

(52) U.S. Cl. ..... 42/69.01

(58) Field of Classification Search ..... 42/69.01, 42/69.02, 69.03, 70.04, 70.05, 70.06, 70.08; 89/132, 139, 141, 144
See application file for complete search history.

(56) References Cited

U.S. PATENT DOCUMENTS 3,167,877 A * 2/1965 Jungeling ..... 42/69.03
3,395,613 A * 8/1968 Browning ..... 89/146
3,797,154 A 3/1974 Seecamp
3,838,531 A 10/1974 Uria et al.
3,845,688 A 11/1974 Seecamp
3,949,509 A 4/1976 Larsson
4,017,996 A 4/1977 Liedke
4,021,955 A * 5/1977 Curtis ..... 42/70.08
4,152,856 A * 5/1979 Tollinger et al. ..... 42/69.01
4,173,964 A * 11/1979 Curran ..... 124/40
4,471,549 A 9/1984 Brint et al.
4,664,015 A 5/1987 Kennedy
4,866,869 A 9/1989 Mainland
4,867,039 A 9/1989 Dobbins
5,018,292 A 5/1991 West
5,373,775 A 12/1994 Findlay, Sr. et al.
5,548,914 A * 8/1996 Anderson ..... 42/66
5,697,178 A 12/1997 Haskell
5,718,074 A 2/1998 Keeney
5,852,891 A 12/1998 Onishi et al.
6,119,387 A 9/2000 Butters et al.
6,131,324 A 10/2000 Jewell (Continued)

OTHER PUBLICATIONS

International Search Report for related Application No. PCT/US2010/027913, mailed Jun. 21, 2010.

(Continued)

*Primary Examiner* — Bret Hayes
(74) *Attorney, Agent, or Firm* — McGuireWoods, LLP; Charles J. Gross

(57) ABSTRACT

A fire control assembly for a firearm includes a trigger engagement link comprising a forward end, a rearward end, and an intermediate portion. The fire control assembly further includes a sear including a bottom portion engageable with the intermediate portion of the trigger engagement link, and a hammer moveable between cocked and firing positions. The hammer includes a link displacement portion operable to displace the forward end of the trigger engagement link as the hammer is moved from its firing position to its cocked position. The displacement of the forward end of the trigger engagement link by the link displacement portion of the hammer disengages the intermediate portion of the trigger engagement link from the bottom portion of the sear so as to at least temporarily deactivate the fire control assembly.

22 Claims, 10 Drawing Sheets

U.S. PATENT DOCUMENTS

| | | | |
|---|---|---|---|
| 6,651,542 | B2 | 11/2003 | Danner et al. |
| 6,668,700 | B1 | 12/2003 | Danner et al. |
| 6,772,548 | B1 | 8/2004 | Power |
| 7,047,685 | B2 | 5/2006 | Diaz et al. |
| 7,131,366 | B2 | 11/2006 | Danner et al. |
| 7,181,880 | B2 | 2/2007 | Keeney |
| 7,430,827 | B1 | 10/2008 | Huber |
| 2007/0051236 | A1* | 3/2007 | Groves et al. ..... 89/142 |
| 2009/0107023 | A1 | 4/2009 | Murphy |

OTHER PUBLICATIONS

Written Opinion for related Application No. PCT/US2010/027913, mailed Jun. 21, 2010.

* cited by examiner

TRIGGER ENGAGEMENT LINK FOR FIREARM

CROSS-REFERENCE TO RELATED APPLICATIONS

This application claims the benefit of U.S. Provisional Patent Application No. 61/162,197, filed Mar. 20, 2009.

INCORPORATION BY REFERENCE

U.S. Provisional Patent Application No. 61/162,197, which was filed on Mar. 20, 2009, is hereby incorporated by reference for all purposes as if presented herein in its entirety.

TECHNICAL FIELD

The present invention generally relates to firearm trigger assemblies, and in particular to a trigger engagement link for firearm trigger assemblies.

BACKGROUND INFORMATION

In most small arms-type firearms, such as handguns, shotguns and various other types of long guns including lever action and semiautomatic rifles, the firearm trigger assemblies or fire control systems thereof generally include a hammer that is held in a cocked position by a mechanical interface with a sear. The sear is connected either directly or through mechanical linkages to the trigger of the firearm. When the trigger is squeezed or moved rearwardly to fire a round of ammunition, the sear generally is moved out of locking engagement with the hammer so as to release the hammer. The hammer then is pivoted into contact with a firing pin of the firearm by a hammer spring. The engagement of the firing pin by the hammer causes the firing pin to strike a round of ammunition in the chamber of the firearm to initiate the firing of the round of ammunition.

In a conventional hammer sear interface, the sear typically includes a notched, hooked portion that engages a corresponding notch or hook formed in the rear hammer. Due to the sliding nature of this mechanical interface, the sear and hammer generally must be precisely machined so as to provide and ensure smooth and even surfaces on both the hammer and sear. This precise machining also provides a smooth and crisp trigger feel during shooting to avoid catching or hesitation during firing, which can lead to misfires and affect the aim of the shooter. The criticality of the components returning to full engagement upon release of the trigger thus further requires that the geometry and surface finishes of the hammer and sear be carefully and somewhat precisely machined and finished, such that the hammer and sear will regain full engagement in such a situation in which the trigger is released after a partial trigger pull without firing. Such precise and careful machining of these components, however, generally is expensive and requires significant quality control and review to ensure that such parts are precisely machined to within specific, narrow ranges of tolerances necessary to provide a smooth interface and function.

SUMMARY

In one embodiment of the disclosure, a fire control assembly for a firearm comprises a trigger engagement link comprising a forward end, a rearward end, and an intermediate portion. The fire control assembly further comprises a sear comprising a bottom portion engageable with the intermediate portion of the trigger engagement link, and a hammer moveable between cocked and firing positions. The hammer comprises a link displacement portion operable to displace the forward end of the trigger engagement link as the hammer is moved from its firing position to its cocked position, wherein the displacement of the forward end of the trigger engagement link by the link displacement portion of the hammer disengages the intermediate portion of the trigger engagement link from the bottom portion of the sear so as to at least temporarily deactivate the fire control assembly.

In another aspect of the disclosure, a firearm comprises a barrel defining a chamber and a fire control assembly comprising a trigger engagement link comprising a forward end, a rearward end, and an intermediate portion. The fire control assembly further comprises a sear comprising a bottom portion engageable with the intermediate portion of the trigger engagement link, and a hammer moveable between cocked and firing positions. The hammer comprises a link displacement portion operable to displace the forward end of the trigger engagement link as the hammer is moved from its firing position to its cocked position, wherein the displacing the forward end of the trigger engagement link by the link displacement portion of the hammer disengages the intermediate portion of the trigger engagement link from the bottom portion of the sear and at least temporarily deactivates the fire control assembly.

BRIEF DESCRIPTION OF THE DRAWINGS

These and various other advantages, features, and aspects of the present invention will become apparent and more readily appreciated from the following detailed description of the embodiments taken in conjunction with the accompanying drawings, as follows.

DETAILED DESCRIPTION

The following description is provided as an enabling teaching of exemplary embodiments. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

The embodiments described are generally directed to a fire control for firearms where the trigger and sear are disengaged and non-operable as the hammer is cocked. While the embodiments described herein illustrate the use of the present invention with a long gun such as a rifle or shotgun, it will be understood that the present invention can be used with various types of long guns, including shotguns and rifles, handguns, and other types of firearms utilizing hammer driven trigger assemblies or fire control systems for firing rounds of ammunition.

Figure 1:
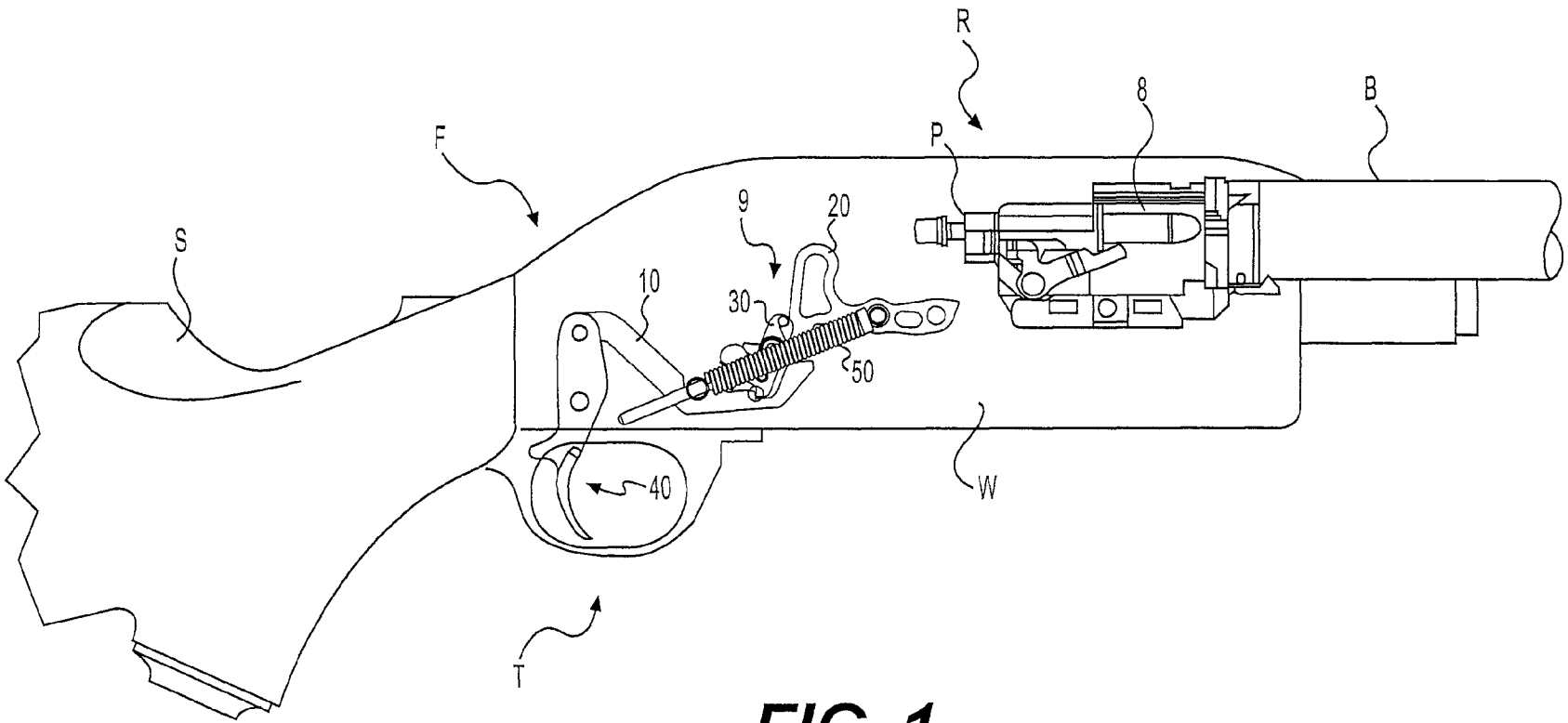
FIG. 1 is a partial cutaway side view of a firearm showing a fire control assembly in an exemplary embodiment.

As generally illustrated in FIGS. 1-5, the embodiments generally include a sear assembly 30 connected via a trigger engagement link 10 to a trigger 40 of a firearm fire control T. The trigger engagement link 10 is disengaged from the sear assembly 30 under certain conditions of the fire control T. FIG. 1 illustrates a partially cutaway view of a firearm F with a stock S, receiver R, and barrel B. The receiver R contains a fire control T and a bolt and firing pin assembly P. A round 8 is shown in a chamber C at a proximal end of the barrel B. The firearm stock, receiver, bolt, firing pin, chamber, barrel, and round are shown generally and by way of example. Variation and omission of one or more of these elements for use with different types of firearms and firearm designs are considered to be within the scope of the present disclosure.

Figure 2:
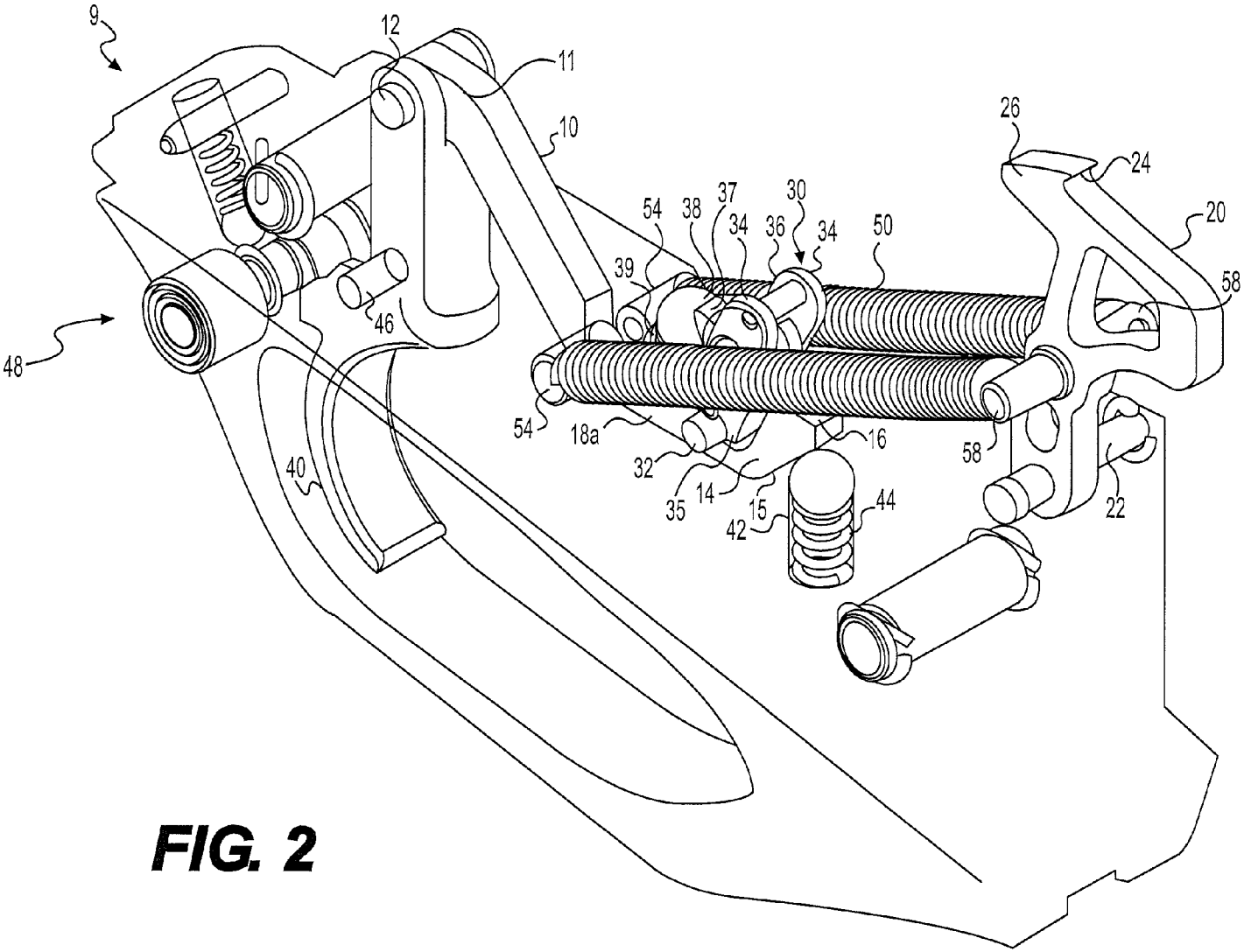
FIG. 2 is a partial cutaway perspective view of the fire control assembly of FIG. 1.

With reference to FIGS. 1 and 2, according to one example embodiment, the fire control assembly T of the firearm F includes a trigger engagement link 10, a hammer 20, a sear assembly 30, and hammer springs 50. The link 10 is pivotally attached to a trigger assembly 40 at a rearward end 11 by a pin 12, while the forward end 14 of the link 10 can be supported by a roller bearing 42 and trigger return spring 44, which provides resistance to forward and downward motion of the forward end 14 of the link. In other words, the spring 44 generally biases the forward end 14 rearwardly and upwardly as needed or desired. The roller bearing 42 engages the forward end 14 at a sloped surface 15. The link 10 can further include a hammer engagement surface 16, which is a generally flat surface at the top of the forward end 14 in the illustrated embodiment. The link 10 can also include a sear notch 18 defined in an intermediate portion 18*a* of the link 10. The intermediate portion 18*a* and the sear notch 18 are shown as generally below the sear assembly 30 in the illustrated embodiment.

According to the illustrated embodiment of FIG. 1, the hammer 20 is pivotably supported by hammer pin 22 attached to the wall W of the receiver R so as to be moveable between a cocked position and a firing position. The hammer further generally includes a catch or notch 24 for engaging the sear assembly 30 and a link displacement protrusion 26 (FIG. 2). The hammer engagement surface 16 can be situated generally below the link displacement protrusion 26 of the hammer 20 when the hammer is in the cocked position. The sear assembly 30 is pivotably attached to the receiver wall W by pin 32 and can include a pair of opposed side plates 34 (FIG. 2), each typically formed from a metal such as steel or other durable, high strength materials and attached together via fasteners such as rivets, bolts, or other similar fastening mechanisms. Alternatively, the sear assembly 30 can be stamped, milled, metal injection molded, or otherwise formed as a single, unitary piece or component. A link interface flange 35 at a lower portion of the sear assembly 30 can be included for engaging the sear notch 18 of the link 10. A roller bearing 36 for engaging the notch 24 of the hammer 20 is mounted between the sear side plates 34 adjacent the upper ends thereof. The sear assembly 30 further can include an intermediate flange 37 that engages a roller bearing 38 and spring 39 that biases the sear assembly 30 in a forward direction.

In the illustrated embodiment, the trigger assembly 40 can be pivotably connected to the wall W of the receiver R by a pin 46 and can include a safety mechanism 48 (FIG. 2). The hammer springs 50 can be anchored to the receiver wall W on either side of the sear assembly 30 by a pin 54 located at one end and connected to the hammer 20 at the other end by pin 58. In the present embodiment, each of the hammer springs 50 is coaxial with a respective hammer spring guide rod 52.

Figure 4A:
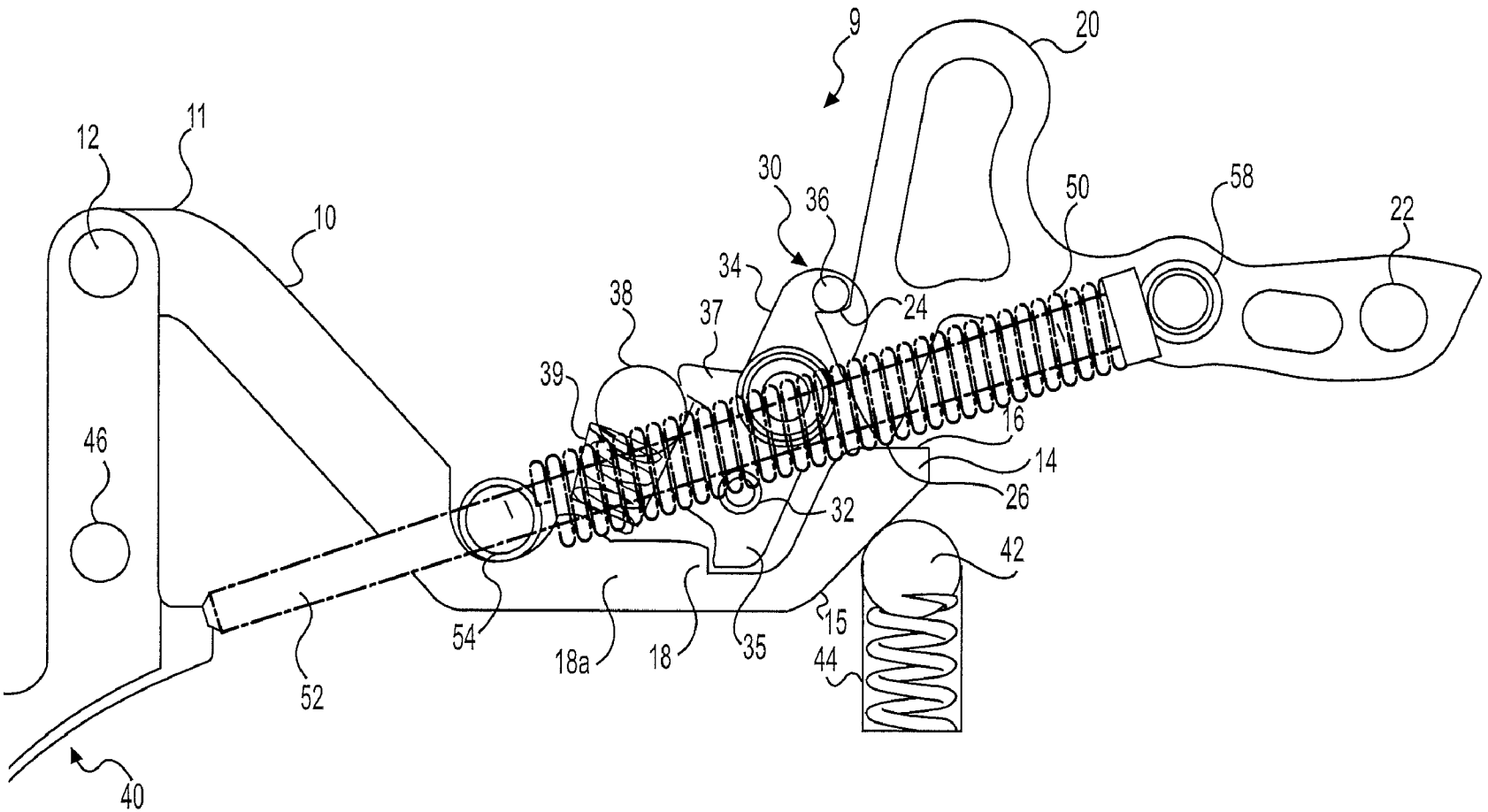
FIGS. 4A-4E illustrate the position of the trigger engagement link, the sear, and a hammer during operation of the firearm.

FIG. 4A illustrates a side view in which the notch 18 of the trigger engagement link 10 is engaged with the flange 35 of the sear assembly 30 with the roller bearing 38 and spring 39 biasing the sear assembly 30 forward, and the bearing 42 and spring 44 biasing the link 10 rearward. The notch 24 of hammer 20 is engaged with the sear roller 36 so as to lock the hammer 20 in a cocked or ready position. As the hammer 20 is moved into engagement with the sear assembly 30, the hammer springs 50 are compressed, and the hammer spring guide rods 52 extend through the springs 50 towards the trigger 40. When the trigger engagement link 10 is pushed downward by movement of the hammer 20 by engagement with the bolt, the trigger engagement link 10 depresses the roller bearing 42 and applies force to trigger return spring 44.

When the trigger 40 is pulled to initiate a firing operation, the trigger engagement link 10 is pushed forward, depressing the roller bearing 42 against the spring force of spring 44 to provide the trigger pull force. The engagement between the link interface flange 35 of the sear assembly 30 and the sear notch 18 of the trigger engagement link 10 continues to push forward as the trigger 40 is pulled and eventually rotates the sear assembly 30 out of an engaged, cocked, and ready-to-fire position so as to release the hammer 20 to move to its firing position to strike the firing pin and fire the firearm.

Figure 3:
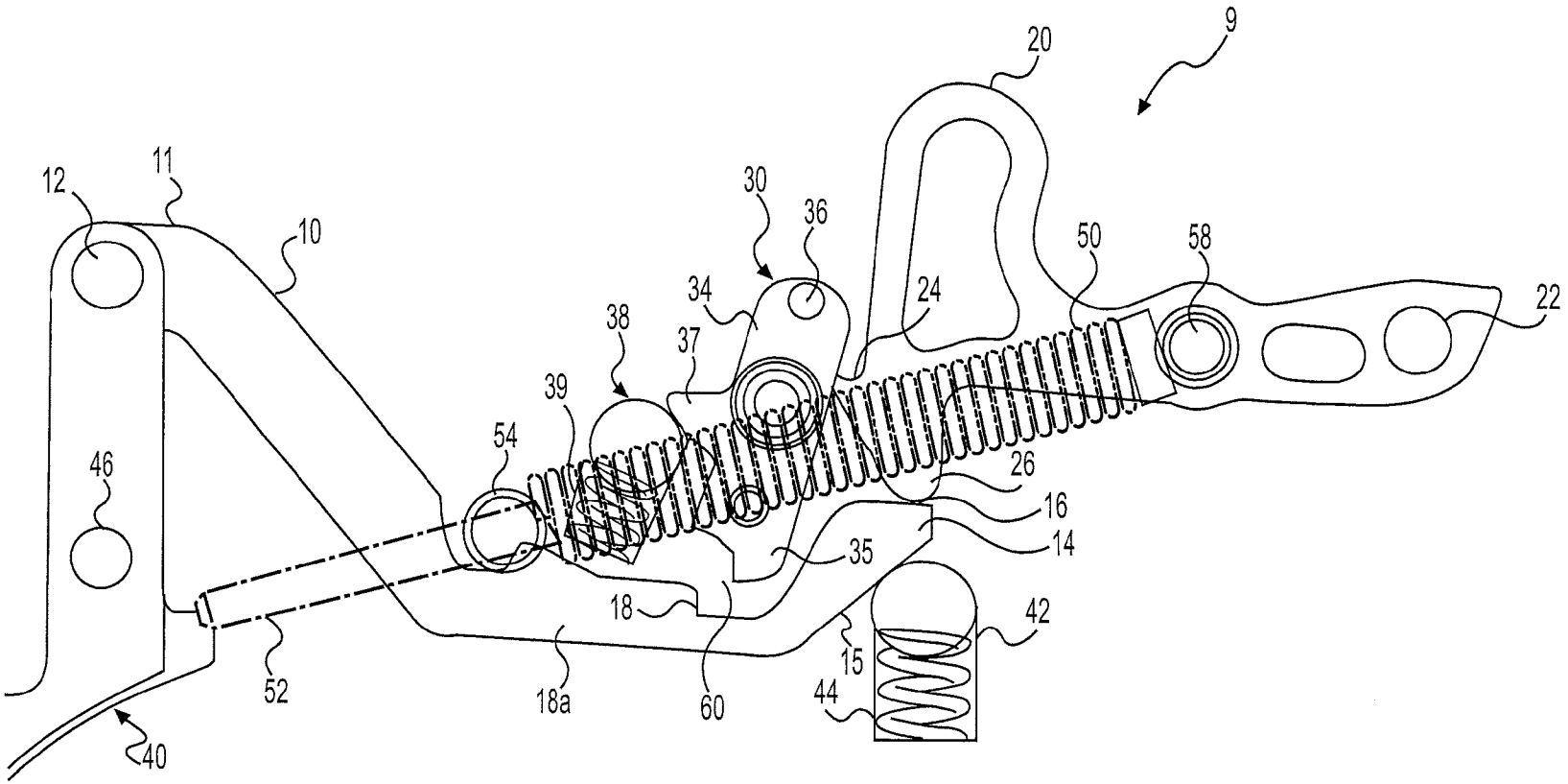
FIG. 3 is a side view of the fire control assembly of FIG. 1 in which a trigger engagement link is disengaged from a roller sear in an exemplary embodiment.

After the firearm is fired, the bolt reciprocates over the top of the hammer 20, pushing the hammer down toward its cocked, ready-to-fire position. At this point, as illustrated in FIG. 3, the protrusion 26 of the hammer 20 is now interfacing with the surface 16 of the trigger engagement link 10. The protrusion 26 strikes or otherwise interacts with the engaging surface 16 to force the forward end 14 of the trigger engagement link 10 downwardly against the roller bearing 42 and spring 44, causing a wide gap 60 between the surface 16 and the flange 35 to disengage the link and sear. This disengagement of the link and sear with the hammer substantially deactivates the firearm thus preventing the firearm from being fired even if the trigger 10 is not released to prevent full automatic operation of the firearm.

FIGS. 4A-4E illustrate the position of the trigger engagement link 10, the sear assembly 30, and hammer 20 during operation of the firearm. In FIG. 4A, the trigger engagement link is engaged with the sear assembly 30 of the firearm and the hammer thereof in its cocked, ready-to-fire position. The sear assembly 30 is biased forward by the spring 39 and the sear roller 36 is in engagement with the notch 24 of the hammer 20 while the springs 50, shown in phantom, push against the hammer at the pin 58. The link 10 is biased rearwardly and the trigger 40 is biased forward by the spring 44.

Figure 4B:
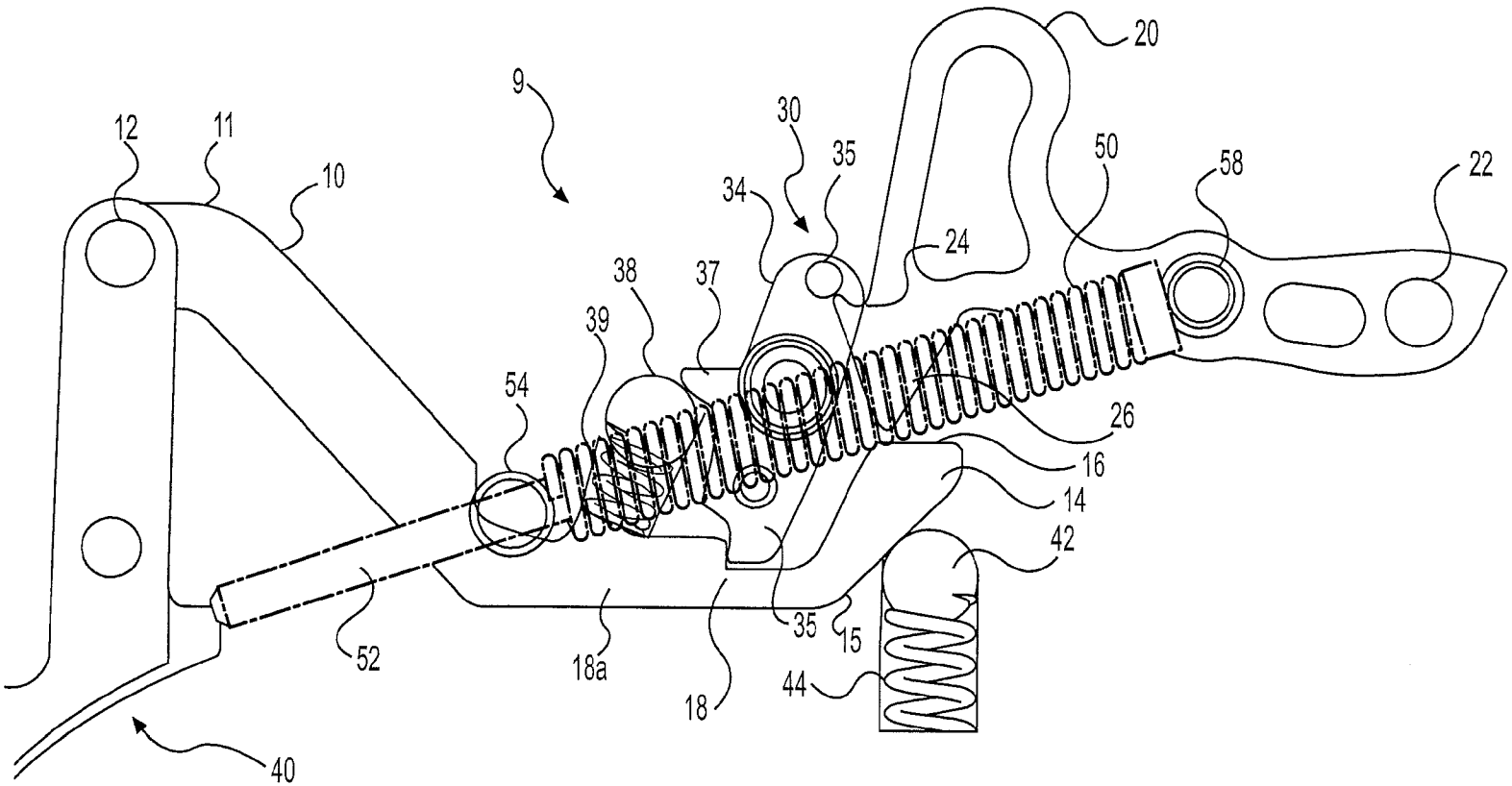
Figure 4C:
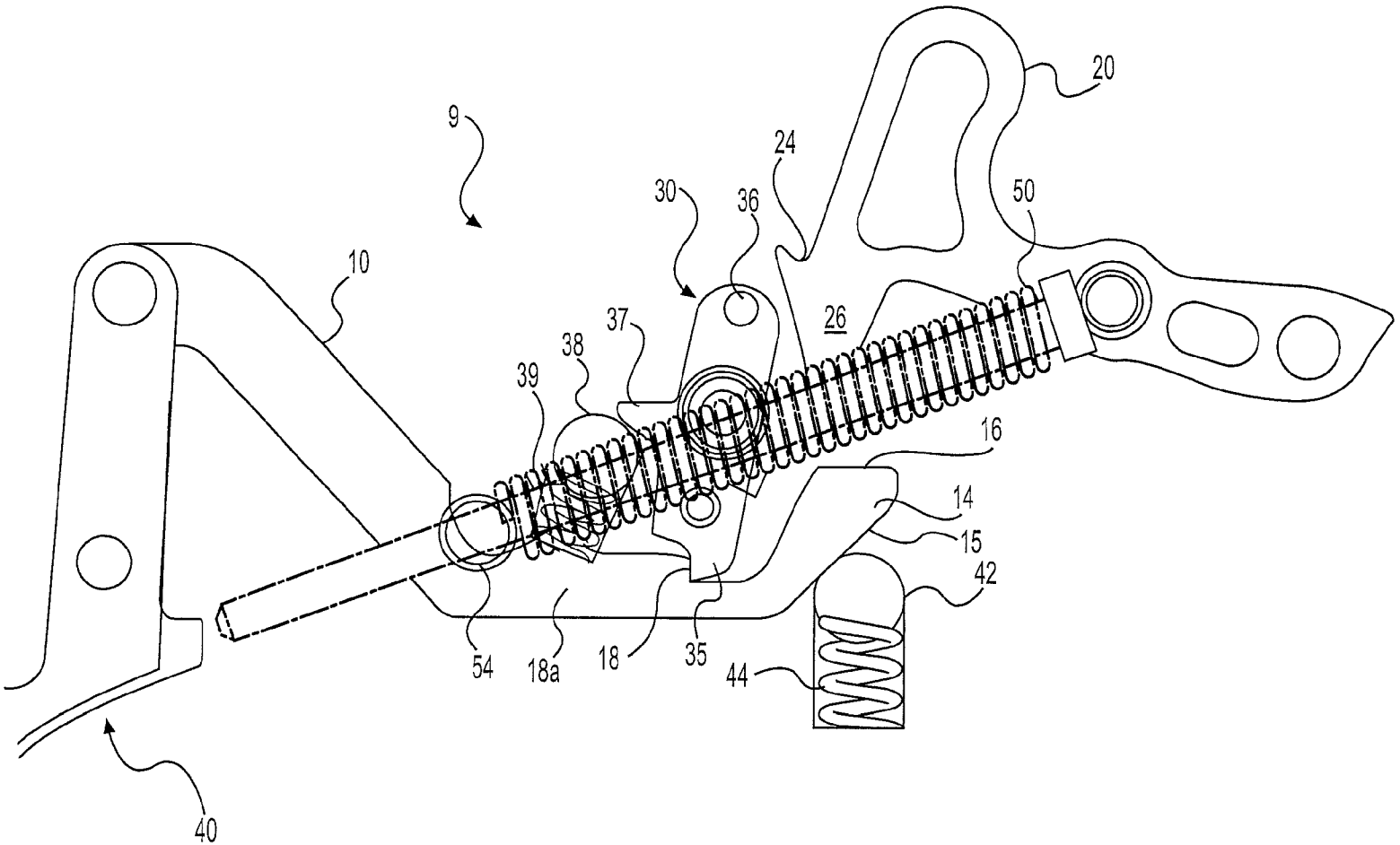
Figure 4D:
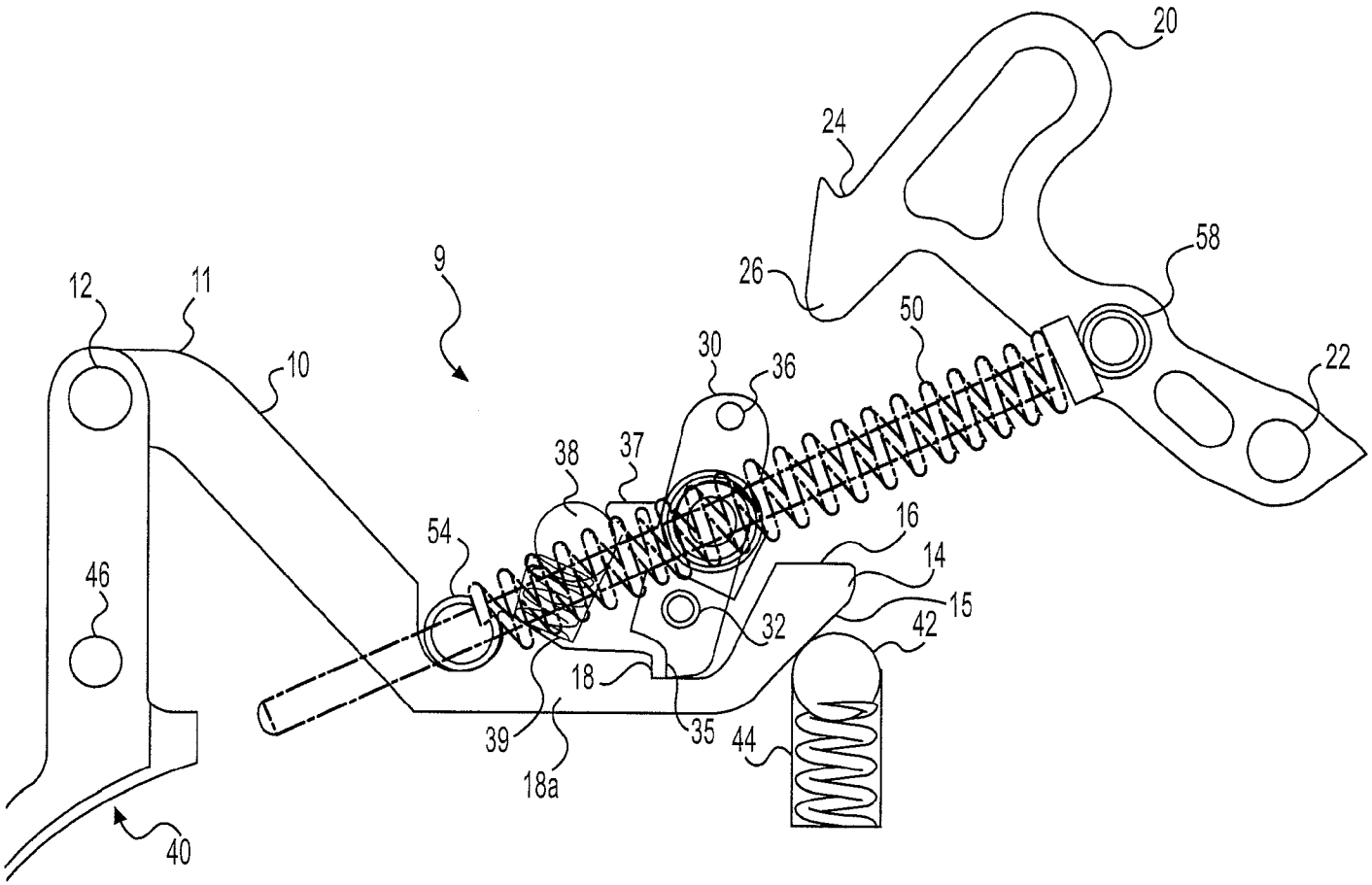

In FIG. 4B, trigger 40 is pulled rearwardly forcing the link 10 forwardly against the spring 44. The sear notch 28 of the link 10 engages the flange 35 of the sear assembly 30 and pivots the sear roller 36 away from the hammer 20 against the spring 39. The roller 36 is disengaged from the notch 24 so that the hammer 20 can pivot forwardly about the pin 22 into its firing position. In FIG. 4C, the hammer 20 is shown rotating forwardly under the biasing force of the hammer springs 50 after firing is initiated and is shown completely clear of sear assembly 30. In FIG. 4D, the hammer 20 is continuing its forward motion as the hammer springs 50 extend between the pins 54, 58 and the guide rods 52 move forward into the springs 50. In the case that the trigger was released after initiating firing, the spring 44 biases the roller bearing 42 up against the sloped surface 15 of the link 10, forcing the link 10 rearwardly so that the sear notch 18 allows the flange 35 to pivot rearward. The rearwardly motion of the link 10 pivots the trigger 40 forward into the pre-firing position. The spring 39 forces the roller bearing 38 against the flange 37 to pivot the sear assembly 30 forward into position so the sear roller 36 can reengage the notch 24 after the firing operation. The link 10, sear assembly 30, and trigger 40 are now in a ready-to-fire position, as shown in FIG. 4D, with the flange 35 situated in the notch 18. Further, the sear assembly 30 is in position for the sear roller 36 to re-engage the notch 24 of the hammer 20 when the hammer is returned to the cocked position.

Figure 4E:
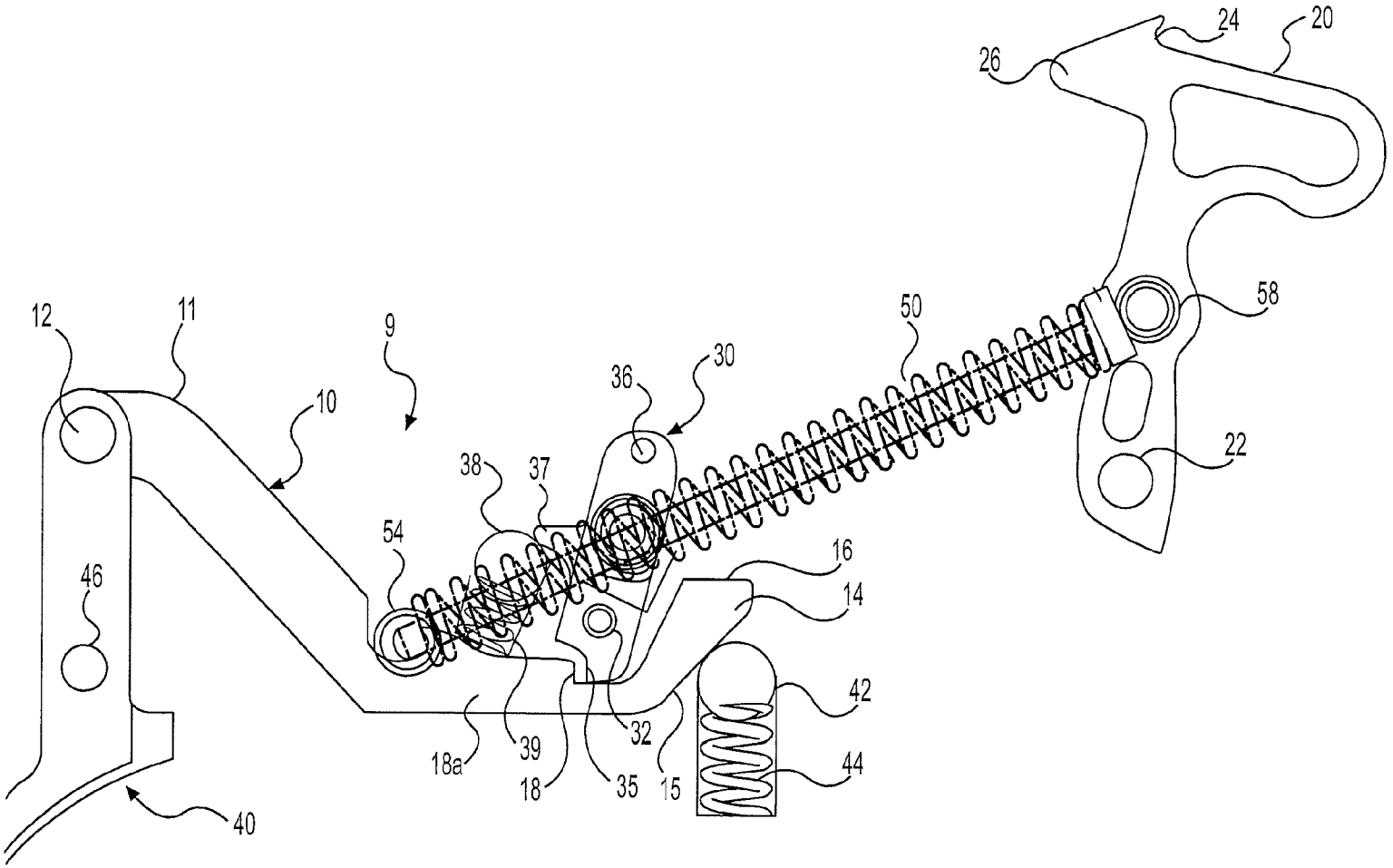

In the exemplary embodiment shown in FIGS. 4D and 4E, the link 10, sear assembly 30, and trigger 40 can be returned to a ready-to-fire position as the released hammer 20 is pivoted from the cocked position to the firing position. It will be understood, however, that the link, sear, and trigger generally will be returned to their ready-to-fire position whenever the trigger 40 is released regardless of the position of the hammer 20.

In FIG. 4E, the hammer 20 is shown having reached its stop or firing position under the force of the hammer springs 50. After firing a round, the bolt forces the hammer 20 rearward against the hammer springs 50 until the hammer 20 pivots down and the protrusion 26 engages the surface 16 to force the link 10 down against the spring 44, as shown in FIG. 3. In a particular embodiment, as the hammer pivots rearward past the sear assembly 30, the sloped surface of the protrusion 26 can engage the roller 36 and pivot the sear rearward slightly. After the notch 24 has passed the roller 36 as shown in FIG. 3, the sear is forced forward by the spring bias of the spring 39. The bias of the spring 44 forces the forward end 14 of the link 10 and the hammer 20 upwardly, and the hammer springs 50 pivot the hammer 20 upwardly until the notch 24 reengages the roller 36, as shown in FIG. 4A. The fire control assembly T is now ready to fire again.

Figure 5:
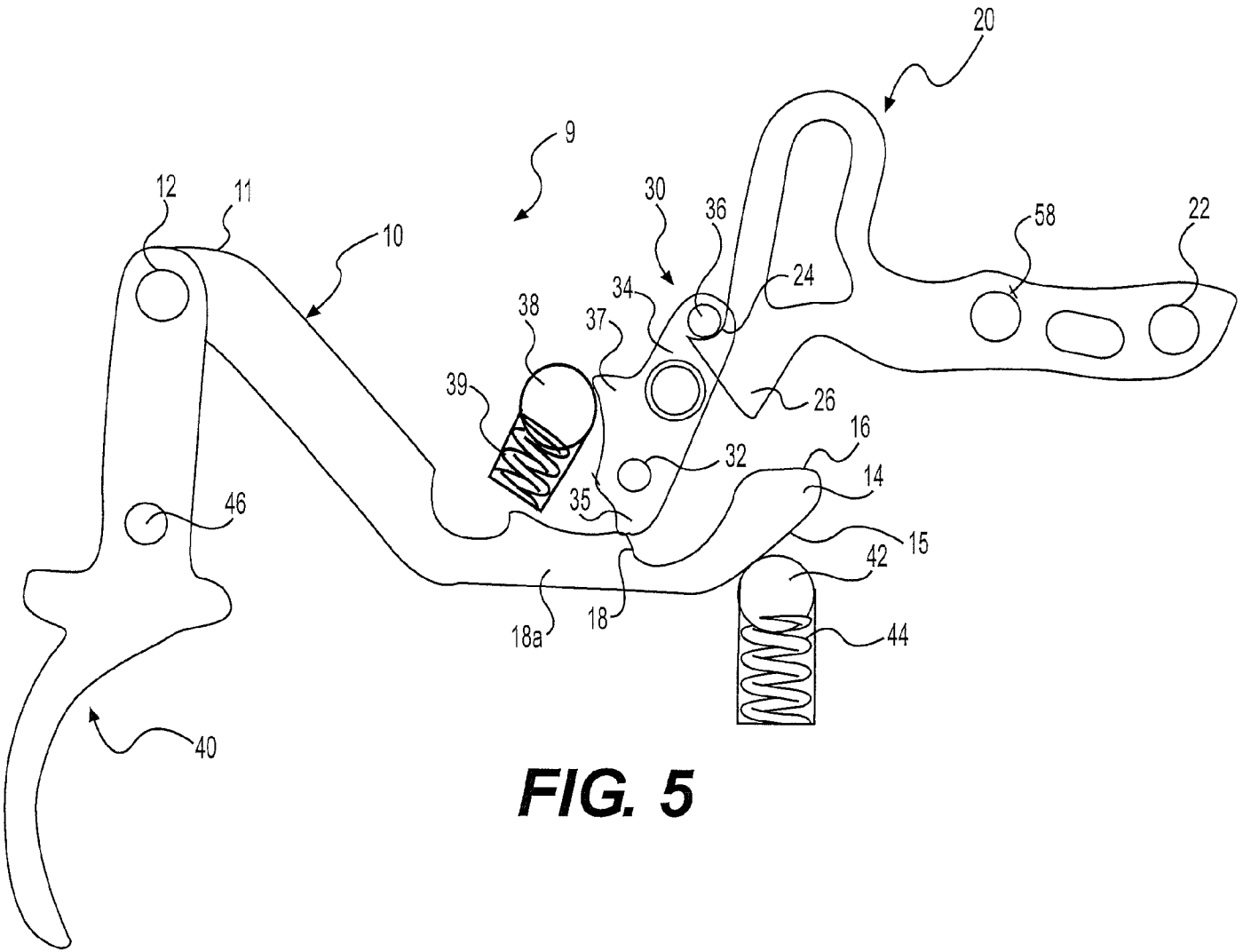
FIG. 5 is a side view of the fire control assembly in which the trigger has not been released during or after the firing operation.

In the case that the trigger 40 is not released after initiating firing and/or prior to the hammer being properly reset to its cocked position, the firing operation proceeds normally. However, the hammer 20 disengages the link 10 from the sear assembly 30 until the trigger 40 is released. Particularly, when the trigger 40 is held during firing, the notch 18 remains in engagement with the flange 35 and prevents the sear assembly 30 from pivoting forward under the spring bias of the spring 39. When the bolt forces the hammer 20 rearward and the protrusion 26 strikes the surface 16, the link 10 is forced downward against the spring 44 similarly to the state shown in FIG. 3. The downward motion of the link 10 disengages the notch 18 from the flange 35. The sear assembly 30 pivots forward and the roller 36 engages the notch 24 when the hammer 20 is pivoted upward by the hammer springs 50 as shown in FIG. 5. The flange 35 interferes with the link 10 at the intermediate portion 18*a* proximate to the notch 18 to maintain the link in a disengaged position against the spring 44, and the firearm cannot be fired again until the trigger 40 is released. Thus, the hammer 20 substantially temporarily deactivates the operability of the fire control assembly and the flange 35 of the sear assembly 30 engages the intermediate portion of the link 10 to the rear of the notch 18 to maintain the fire control assembly in the deactivated state until the trigger 40 is released.

Releasing the trigger 40 when the fire control assembly T is in the disengaged state shown in FIG. 5 allows the spring bias of the spring 44 to force the roller bearing 42 upward against the sloped surface 15 of the forward end 14 of the link 10, which forces the link rearward and the trigger 40 forward to the ready-to-fire position. When the notch 18 passes the flange 35, the link 10 is allowed to pivot upward under the bias of the spring 44. The fire control assembly is now returned to the pre-firing state shown in FIG. 4A, and the notch 18 can engage the flange 35 to pivot the sear assembly 30 and release the hammer 20 when the trigger 40 is pulled again.

In operation, if the trigger 40 is pulled while cocking the firearm, the sear assembly 30 and trigger engagement link 10 are disengaged and the firearm cannot fire. If the trigger is released while cocking the firearm, and the sear assembly 30 and trigger engagement link 10 are disengaged, the firearm cannot fire. If the trigger 40 is released and the bolt is forward, the return spring 39 re-engages the sear catch with the hammer 20. If the trigger 40 is not released during the bolt cycling, the sear assembly 30 and trigger engagement link 10 are disengaged and the firearm cannot fire. The trigger 40 must be released to enable release of the link and full recocking of the hammer to place the firearm in a condition for firing prior to being able to fire the firearm.

Various alternate configurations of the fire control assembly are considered to be within the scope of the present invention. In alternative embodiments, the roller bearing 42 and spring 44 can be otherwise oriented or arranged with respect to the forward end 14 of the link 10. For example, the roller bearing 42 and the spring 44 can be arranged so that the spring extends in a direction generally normal to the sloped surface 15.

Figure 6:
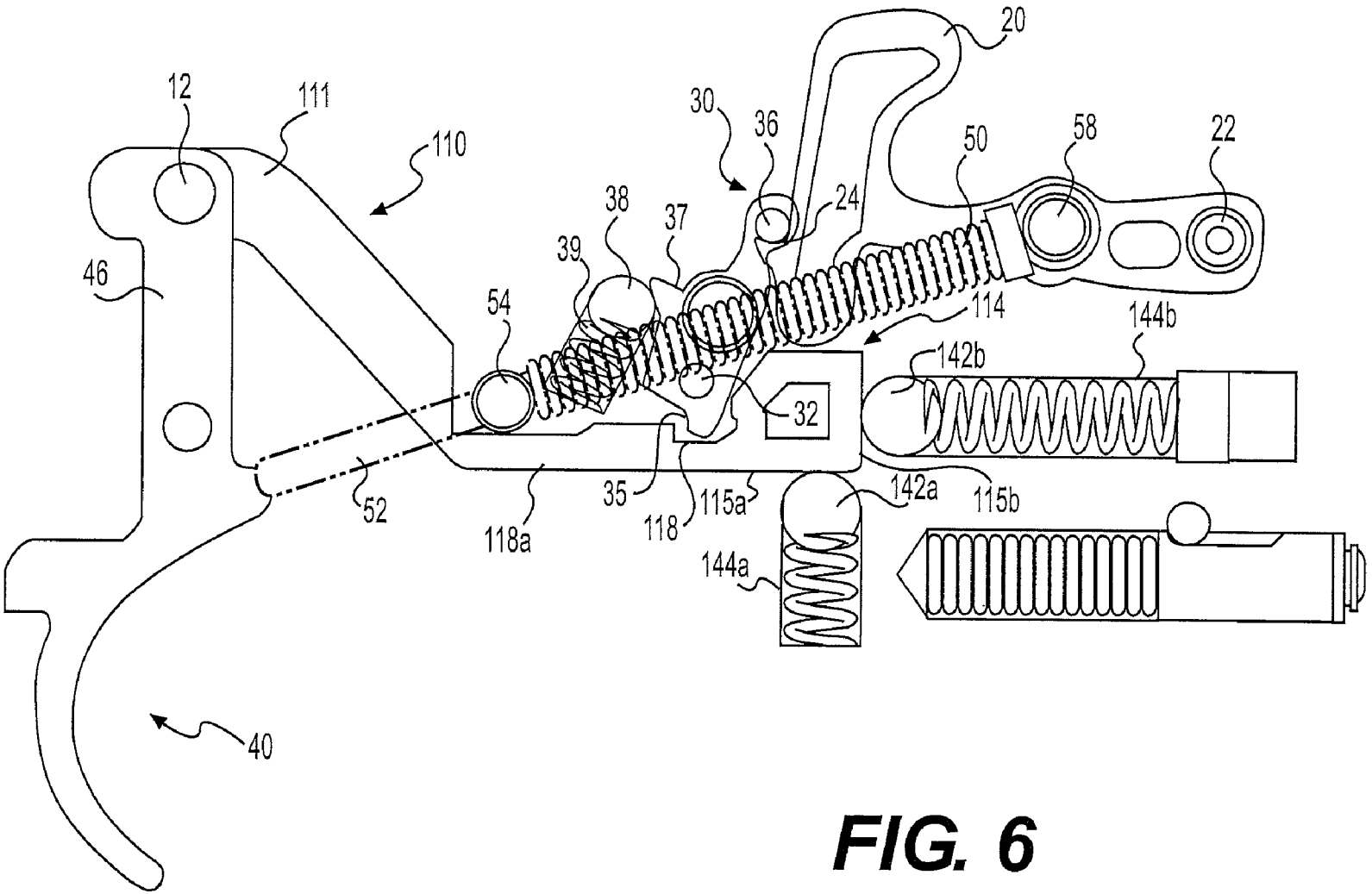
FIG. 6 is a side view of a fire control assembly in an alternative embodiment.

In a further alternative embodiment shown in FIG. 6, the trigger engagement link 110 includes a rearward end 111, an intermediate portion 118*a* having a sear notch 118 formed therealong, and a forward end 114. As FIG. 6 indicates, in this embodiment the intermediate portion 118*a* of the link 110 can have a substantially flat lower or bottom engaging surface that terminates at the forward end 114, and with the forward end extending vertically, substantially normal to the intermediate portion. The forward end 114 can be supported and biased by roller bearings 142*a*, 142*b*, sear engagement spring 144*a*, and trigger return spring 144*b* that cooperate to provide resistance against the downward and forward motion of the forward end 114 of the link. In the configuration of the present embodiment, the link 110 acts on the orthogonal springs 144*a*, 144*b* generally in the direction in which each of the respective springs extend. Any force on the roller bearings 142*a*, 142*b* applied by link 110 in a direction that is transverse to the respective springs 144*a*, 144*b* generally can be reduced in the present configuration with respect to the sloped surface 15 of the link 10 in the previous embodiment.

As can be seen in FIG. 6, the biasing force acting on the forward end 114 is divided between the sear engagement spring 144*a* biasing the forward end 114 in a generally upward direction, while the trigger return spring 144*b* biases the forward end in a generally rearward or longitudinal direction. The roller bearing 142*a* engages the forward end 114 at a generally horizontal surface 115*a*, and the roller bearing 142*b* engages the forward end at a generally vertical surface 115*b*. The fire control of this alternate embodiment operates similarly to the fire control with link 10 except that the springs 144*a*, 144*b* bias the forward end 114 independently of each other. As the trigger 40 is pulled, the link 110 moves forwardly against the generally horizontally-extending trigger return spring 144*b*, and when the hammer 20 forces the forward end 114 of the link 110 downwardly, as discussed with respect to the operation of the fire control assembly described above, the forward end 114 moves against the generally vertically-extending sear engagement spring 144*a*. As a result, with the configuration of the present embodiment the resistance of the trigger or the trigger feel can be adjusted without significantly affecting the upward biasing force acting on the forward end of the trigger engagement link by the sear engagement spring 144*a*. In particular, the trigger return spring 144*b* can be changed or adjusted to increase or decrease the rearward force on the link 110, and thus the amount of force required for actuation of the trigger, without affecting the upward biasing force of the sear engagement spring 144*a* applied against the forward end of the trigger engagement link.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed:

1. A fire control assembly for a firearm, the fire control assembly comprising:

a trigger engagement link comprising a forward end, a rearward end, and an intermediate portion;

a sear comprising a bottom portion engageable with the intermediate portion of the trigger engagement link; and a hammer moveable between cocked and firing positions and having a link displacement portion operable to displace the forward end of the trigger engagement link as the hammer is moved from its firing position to its cocked position, wherein the displacement of the forward end of the trigger engagement link by the link displacement portion of the hammer disengages the intermediate portion of the trigger engagement link from the bottom portion of the sear so to at least temporarily deactivate the fire control assembly.

2. The fire control assembly of claim 1, wherein the forward end of the trigger engagement link is biased upwardly and rearwardly, and the sear is pivotable about a sear pin, and wherein a top portion of the sear is biased forwardly and the bottom portion of the sear is biased rearwardly.

3. The fire control assembly of claim 2, further comprising a trigger return spring that biases the forward end towards the sear and a sear spring that biases the top portion of the sear towards the hammer.

4. The fire control assembly of claim 3, the forward end of the trigger engagement link comprising a sloped surface, and wherein the trigger return spring biases a trigger return bearing toward engagement with the sloped surface of the forward end of the trigger engagement link.

5. The fire control assembly of claim 3, the sear comprising a sear roller at the top portion of the sear and an intermediate flange, wherein the sear spring biases a sear bearing toward engagement with the intermediate flange for urging the sear roller towards the hammer for engaging a catch extending from the hammer when the hammer is in its cocked position.

6. The fire control assembly of claim 2, further comprising a sear engagement spring biasing the forward end of the trigger engagement link in a generally upward direction and a trigger return spring biasing the forward end of the trigger engagement link in a generally rearward direction.

7. The fire control assembly of claim 2, the intermediate portion of the trigger engagement link comprising a sear notch and the bottom portion of the sear comprising a link interface flange, the sear notch adapted to engage the link interface flange.

8. The fire control assembly of claim 7, further comprising a trigger pivotably connected to the rearward end of the trigger engagement link, whereby movement of the trigger urges the trigger engagement link forwardly so that the sear notch urges the link interface flange forwardly to pivot the top portion of the sear away from the hammer, thereby releasing the hammer.

9. The fire control assembly of claim 8, wherein as the hammer is moved from its firing position to its cocked position the intermediate portion of the trigger engagement link is disengaged from the bottom portion of the sear such that, the link interface flange of the sear is operable to prevent the sear notch from engaging the link interface flange by engaging the intermediate portion of the trigger engagement link proximate to the sear notch until the trigger is released.

10. The fire control assembly of claim 2, the forward end of the trigger engagement link comprising a hammer engagement surface, and the link displacement portion of the hammer comprising a link displacement protrusion operable to contact the hammer engagement surface to disengage the trigger engagement link from the sear as the hammer is moved towards its cocked position.

11. The fire control assembly of claim 2, the hammer comprising a catch and being biased forwardly by at least one hammer spring, and the sear comprising at least two side plates with a sear roller extending between an upper portion of the at least two side plates, wherein the catch is for engaging the sear roller to lock the hammer in its cocked position between operations of the fire control assembly.

12. A firearm comprising;

a barrel defining a chamber; and a fire control assembly comprising a trigger;

a trigger engagement link comprising a forward end, a rearward end, and an intermediate portion;

a sear comprising a bottom portion engageable with the intermediate portion of the trigger engagement link; and a hammer moveable between cocked and firing positions and having a link displacement portion operable to displace the forward end of the trigger engagement link as the hammer is pivoted from its firing position to its cocked position, wherein the displacement of the forward end of the trigger engagement link by the link displacement portion of the hammer disengages the intermediate portion of the trigger engagement link from the bottom portion of the sear and at least temporarily deactivates the fire control assembly.

13. The firearm of claim 12, wherein the forward end of the trigger engagement link is biased upwardly and rearwardly, and the sear is pivotable about a sear pin, and wherein a top portion of the sear is biased forwardly and the bottom portion of the sear is biased rearwardly.

14. The firearm of claim 13, further comprising a trigger return spring that biases the forward end towards the sear and a sear spring that biases the top portion of the sear towards the hammer.

15. The firearm of claim 14, the forward end of the trigger engagement link comprising a sloped surface, and wherein the trigger return spring biases a trigger return bearing toward engagement with the sloped surface of the forward end of the trigger engagement link.

16. The firearm of claim 14, the sear comprising a sear roller at the top portion of the sear and an intermediate flange, wherein the sear spring biases a sear bearing toward engagement with the intermediate flange for urging the sear roller towards the hammer and engaging a catch extending from the hammer when the hammer is in its cocked position.

17. The firearm of claim 13, further comprising a sear engagement spring biasing the forward end of the trigger engagement link in a generally upward direction and a trigger return spring biasing the forward end of the trigger engagement link in a generally rearward direction.

18. The firearm of claim 13, the intermediate portion of the trigger engagement link comprising a sear notch and the bottom portion of the sear comprising a link interface flange, the sear notch adapted to engage the link interface flange.

19. The firearm of claim 18, further comprising a trigger connected to the rearward end of the trigger engagement link, whereby movement of the trigger urges the trigger engagement link forwardly so that the sear notch urges the link interface flange forwardly to pivot the top portion of the sear away from the hammer, thereby releasing the hammer.

20. The firearm of claim 19, wherein moving the hammer from its firing position to its cocked position causes the intermediate portion of the trigger engagement link to disengage from the bottom portion of the sear, the link interface flange of the sear is operable to prevent the sear notch from engaging the link interface flange by engaging the intermediate portion of the trigger engagement link proximate to the sear notch until the trigger is released.

21. The firearm of claim 13, the forward end of the trigger engagement link comprising a hammer engagement surface, and the link displacement portion of the hammer comprising a link displacement protrusion operable to contact the hammer engagement surface to disengage the trigger engagement link from the sear as the hammer is pivoted toward its cocked position.

22. The firearm of claim 13, the hammer comprising a catch and being biased forwardly by at least one hammer spring, and the sear comprising at least two side plates with a sear roller extending between an upper portion of the at least two side plates, wherein the catch is for engaging the sear roller to lock the hammer in its cocked position between movement and release of the trigger.

* * * * *